US006558196B2

(12) United States Patent
Festag

(10) Patent No.: US 6,558,196 B2
(45) Date of Patent: May 6, 2003

(54) SHIELDING PLATE FOR PLUGGABLE ELECTRICAL COMPONENTS

(75) Inventor: Mario Festag, Berlin (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/927,552

(22) Filed: Aug. 9, 2001

(65) Prior Publication Data

US 2002/0094722 A1 Jul. 18, 2002

(30) Foreign Application Priority Data

Jan. 15, 2001 (DE) ..... 101 02 461

(51) Int. Cl.[7] ..... H01R 13/648
(52) U.S. Cl. ..... 439/607; 439/544; 439/557
(58) Field of Search ..... 439/607, 608, 439/609, 620, 557, 544

(56) References Cited

U.S. PATENT DOCUMENTS

| | | | | |
|---|---|---|---|---|
| 4,812,137 A | | 3/1989 | Wilson et al. | |
| 5,755,595 A | | 5/1998 | Davis et al. | |
| 5,766,041 A | * | 6/1998 | Morin et al. | 439/609 |
| 6,066,001 A | | 5/2000 | Liptak et al. | |

FOREIGN PATENT DOCUMENTS

| | | |
|---|---|---|
| EP | 0 437 931 A2 | 7/1991 |
| EP | 0822623 A1 | 2/1998 |
| EP | 1 011 176 A1 | 6/2000 |
| EP | 1026785 A2 | 8/2000 |
| TW | 258377 | 9/1995 |
| WO | WO 00/13054 | 3/2000 |

* cited by examiner

*Primary Examiner*—P. Austin Bradley
*Assistant Examiner*—Truc Nguyen
(74) *Attorney, Agent, or Firm*—Laurence A. Greenberg; Werner H. Stemer; Ralph E. Locher

(57) ABSTRACT

The shielding plate receives pluggable electrical components, in particular optoelectronic transceivers. The shielding plate has an at least partially casing-shaped main portion and contact springs formed on the main portion for the electrical contact of the shielding plate with a metallic structure. A first part of the main portion can be placed within the metallic structure and a second part of the main portion can be inserted through a cutout of the metallic structure. The contact springs are projections formed on the extreme ends of the main portion and bent back toward the main portion. The ends of the bent-back projections electrically contact the main portion in a rear region which, in the electrical bonding of the metallic structure by the contact springs, lies within the metallic structure.

9 Claims, 5 Drawing Sheets

SHIELDING PLATE FOR PLUGGABLE ELECTRICAL COMPONENTS

BACKGROUND OF THE INVENTION

Field of the Invention

The invention relates to a shielding plate for pluggable electrical components, in particular opto-electronic transceivers. The shielding plate has an at least partially casing-shaped main portion and contact springs formed on the main portion for the electrical bonding of the shielding plate with a metallic structure. It is possible for a first part of the main portion to be arranged within the metallic structure and for a second part of the main portion to be inserted through a cutout of the metallic structure.

It has been known in the pertinent art to dispose opto-electronic transceivers in a pluggable manner on a printed-circuit board. Known in particular are pluggable transceivers of a small construction, known as small form-factor pluggable (SFP) transceivers. They are arranged in a housing on a printed-circuit board. Infrared light is coupled into and out of the transceiver via a plug receptacle which is arranged on the transceiver or coupled to it and into which an optical connector can be plugged.

A corresponding prior art housing is represented in FIG. 5. The housing 1 comprises an upper part (top cage) 22 and a lower part (bottom cage) 21. The two cages can be connected to each other in an engageable manner and they form a receiving housing into which a non-illustrated transceiver can be plugged in the direction of the double-headed arrow A-B or from which a transceiver can be unplugged. At the same time, the housing 1 serves as a shielding plate for the electromagnetic shielding of the pluggable transceiver.

The conventional transceiver has optoelectronic transducers such as a Fabric Perot laser or VCSEL laser and a photodiode. Infrared light is coupled in and out between the transceiver and an optical network via a plug receptacle or more generally an optical port which is arranged in the region of the end face of the housing.

The lower housing part 21 is fastened on a printed-circuit board 5. Furthermore, mounted inside the housing and directly on the printed-circuit board 5 is an electrical connector 4, via which the plugged-in transceiver can be connected to the printed-circuit board 5 and into which the transceiver is plugged when it is plugged into the housing 1.

For electromagnetic shielding against interference emissions, the housing is formed in the region of the optical port as an essentially enclosing shielding plate 3. In alternative configurations, the shielding plate is thereby a separate part which surrounds the housing in the region of the optical port. For electrical connection with a reference potential, the shielding plate 3 is connected via contact springs 31 to a non-illustrated metallic structure, for instance the rear wall of a housing which contains the board with the transceiver and further components. FIG. 6 schematically shows how the housing or shielding plate is inserted through such a rear wall 6.

For forming the contact springs 31, clearances 32 are punched into the shielding plate 3, thereby producing slit structures in the shielding plate 3. The slit structures have the disadvantageous result that the shielding effect of the shielding plate is reduced, since undesirable coupling out of electromagnetic waves takes place. In addition, narrow constrictions 33 (bottlenecks) occur between the slits and the end face of the shielding plate and additionally lead to intensified interference emission of electromagnetic rays. In this case, it is particularly disadvantageous that the bottlenecks 33 lie in front of the metallic structure of the rear wall, and consequently outside the housing of the transceiver, and can consequently radiate undisturbed into the outside space.

SUMMARY OF THE INVENTION

The object of the present invention is to provide a shielding plate for pluggable electrical components, and specifically for optoelectronic transceivers, which overcomes the above-noted deficiencies and disadvantages of the prior art devices and methods of this general kind, and which effectively suppresses interference emissions by electromagnetic waves and, for this purpose, prevents coupling out of electromagnetic waves.

With the above and other objects in view there is provided, in accordance with the invention, a shielding plate for pluggable electrical components, in particular for an opto-electronic transceiver, comprising:

an at least partially casing-shaped main portion having a first part, a second part, and a forward end;

contact springs formed on the forward end of the main portion for electrically bonding the shielding plate with a metallic structure having a cutout formed therein for receiving the main portion to be inserted therethrough, whereby the first part is disposed inside the metallic structure and the second part is insertible through the cutout;

the contact springs being projections integrally formed in one piece with the main portion at the forward end and bent back toward the first part of the main portion such that ends of the bent-back projections electrically contact the main portion at the first part which, when the contact springs are in electrical contact with the metallic structure, is disposed inside the metallic structure.

In other words, the shielding plate according to the invention is distinguished by the fact that the contact springs are formed by projections arranged at the extreme ends of the main portion and bent back toward the main portion and that the ends of the bent-back projections thereby electrically bond with the main portion in a rear region which, in the electrical bonding of the metallic structure by the contact springs, lies within the metallic structure. The rear region electrically bonded by the projections is located in particular behind a rear wall of the metallic structure.

The invention makes it possible on the basis of the bonding of the contact springs to the main portion at the extreme ends for the main portion to be formed as an essentially continuous part which has no or only a reduced number of clearances, slits etc. As a result, coupling out of electromagnetic waves is effectively prevented and improved shielding is provided.

The solution according to the invention provides in particular a chimney structure of the shielding plate, which does not allow any coupling out of electromagnetic waves through clearances in the surface of the shielding plate and provides effective shielding against interference emissions.

The configuration according to the invention also prevents interference potentials from being conducted initially via the shielding plate to the outside, i.e. to the region of the shielding plate which lies outside the metallic structure. Rather, interfering currents are conducted in the contact springs through the rear contact with the main portion back into the inner region of the metallic structure and are hindered from being radiated. Consequently, radiation essentially takes place only within the metallic structure and does not enter the outside space, so that reduced radiation is achieved.

In accordance with an added feature of the invention, the main portion is formed as a continuous part. In this preferred configuration of the invention, the main portion of the shielding plate is formed as an essentially continuous part which has no clearances, slits etc. The invention is also suitable however for a main portion which additionally has slits or other clearances, the number of clearances being at least reduced by the invention.

In accordance with an additional feature of the invention, the main portion is a cut-open main portion and the projections are a comb-like, partial elongation of the cut-open main portion.

In accordance with another feature of the invention, the projections are substantially rectangular projections.

In accordance with a further feature of the invention, the first part has a rear region and the contact springs rest resiliently on the rear region.

The term shielding plate is understood for the purposes of the invention as meaning any desired shielding element which is distinguished by high conductivity both for direct current and for frequencies into the microwave range and is consequently suitable as a shielding element. The shielding plate will generally consist of a highly conductive plate material. However, other materials are also conceivable.

The fact that the main portion and the projections forming the contact springs are formed in one piece, i.e. as one part, permits simple production of the shielding plate from one part.

Furthermore, the projections forming the contact springs are preferably formed as comb-like, partial elongations of the cut-open main portion. Consequently, the main portion and projections can be produced in a simple way by punching. After punching of a planar plate part which forms the main portion and the projections, the main portion is bent into the desired shape of the main portion and the comb-like projections are bent through 180° in the direction of the outer surface of the main portion, whereby the desired contact springs are produced without the main portion having any clearances or slits.

The bent-back contact springs preferably rest resiliently on the rear region of the main portion, which is facing away from the end face provided with the contact springs, i.e. a resilient contact with the rear region of the main portion is established. As already mentioned, this region is located within the metallic structure which surrounds the transceiver.

In accordance with again an added feature of the invention, the casing-shaped main portion forms a part of a two-part housing configured to be placed onto a printed-circuit board and is intended for receiving an electrical component, the housing comprising an upper part and a lower part. In this preferred embodiment, the shielding plate is part of a two-part housing which can be placed onto a printed-circuit board and is intended for receiving the electrical component, the housing comprising an upper part and a lower part. The upper part in this case forms on the lower edge of the side faces a lug which can be inserted into a slit of the lower part and can be bent around for fastening the upper part and lower part. In addition, resilient projections which bear against the upper part are provided on the lower part. As a result, intensified radiation in the region of the slits caused by the two-part design of the housing is prevented.

In accordance with again an additional feature of the invention, the upper part is formed with side faces having a lower end and a lug formed on the lower end to be inserted into a slit formed in the lower part, wherein the lug can be bent over for fastening the upper part and the lower part to one another.

In accordance with again another feature of the invention, the lower part is formed with resiliently formed projections bearing against the upper part.

In accordance with a concomitant feature according to the invention, an inner shielding plate (in addition to the main shielding plate) is disposed within the casing-shaped main portion and in electrical contact with an inner surface of the main portion. The inner shielding plate is an integral part of the pluggable transceiver. In this configuration, within the shielding plate there is additionally arranged an inner shielding plate, which is in electrical contact with the inner surface of the main portion and, for example, additionally shields the transceiver. The inner shielding plate serves in this case on the one hand for linking a metallic LASER flange to the shielding plate, consequently for discharging to the shielding plate interference potentials that occur. On the other hand, the effective opening of the "chimney" formed by the main portion, and consequently the opening diameter of the non-metallic aperture for the LASER and receiver flange, is reduced by the inner shielding plate. As a result, the cutoff frequency for electromagnetic waves possibly getting through it is increased, and consequently the shielding effect in the relevant frequency range is improved.

Other features which are considered as characteristic for the invention are set forth in the appended claims.

Although the invention is illustrated and described herein as embodied in a shielding plate for pluggable electrical components, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 5:
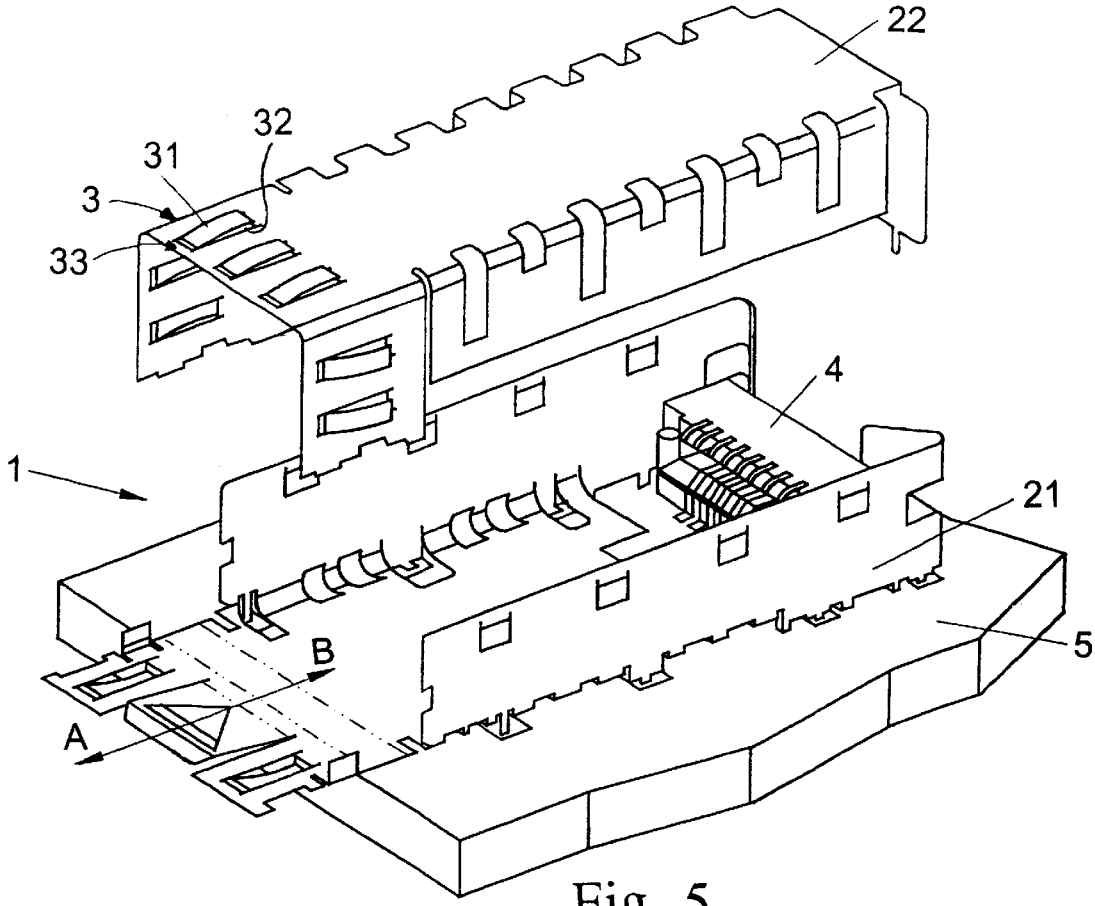
Fig. 5 PRIOR ART
FIG. 5 is an exploded view of a housing according to the prior art.
Figure 6:
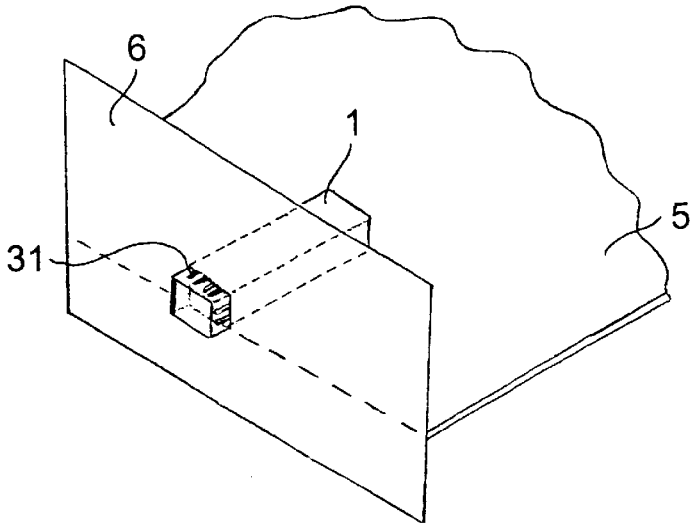
Fig. 6 PRIOR ART
FIG. 6 is a perspective view of a housing according to the prior art inserted through a metallic rear wall.

In explaining the differences between the invention and the prior art, reference is had to the introductory text wherein the construction of a prior art shielding plate is described with reference to FIGS. 5 and 6.

Figure 1:
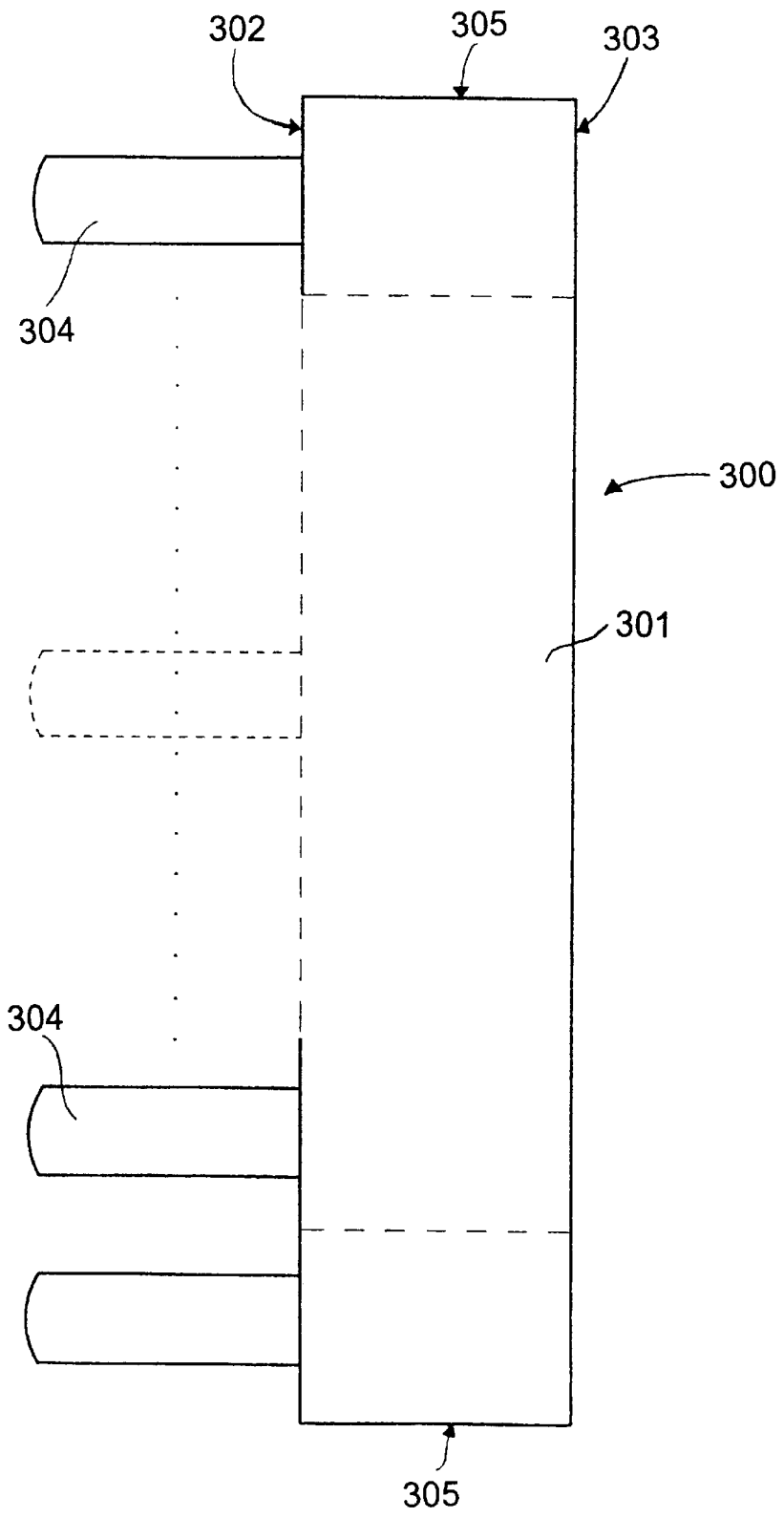
FIG. 1 is a plan view of a cut-open main portion of a shielding plate with comb-like projections.

Referring now once more to the figures of the drawing in detail and first, particularly, to FIG. 1 thereof, there is seen a schematic of a shielding plate 300 according to the invention in the cut-open, unrolled state. The shielding plate 300 has a main portion 301, which in the cut-open state according to FIG. 1 has a rectangular shape. The main portion 301 has two end faces 302, 303. Along the end face 302, the main portion 301 is adjoined in a comb-like manner by projections 304, which are formed essentially in a rectangular manner and represent linear elongations of the main portion 301. The main portion 301 and the projections 304 are in this case formed in one part and are preferably produced as a punched part.

The plate used for the shielding plate 300 has a high conductivity and a high resilience, for instance copper beryllium, in order to prevent coupling out of electromagnetic rays as reliably as possible.

For the production of the shielding plate 300 according to the invention, the main portion 301 is folded into a desired shape for the main portion and at the same time the lateral ends of the main portion 301 are connected to each other. The shielding plate 300 is thereby preferably given a cuboid shape, the main portion 301 forming the four longitudinal bounding faces of a cuboid by corresponding folding. The projections 304 are bent around to the rear through 180° to produce contact springs, the contact springs being in the form of leaf springs.

Figure 2:
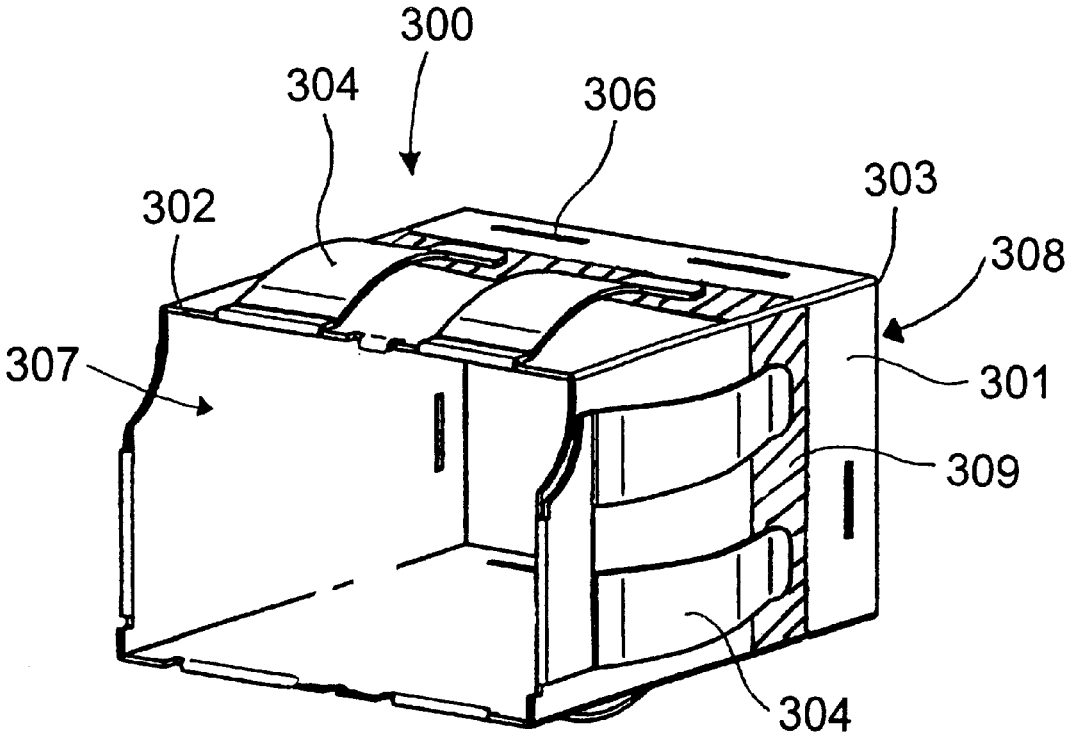
FIG. 2 is a perspective view of a shielding plate according to the invention.

A shielding plate 300 folded in this way is represented in FIG. 2. The main portion 301 forms an enclosing housing, which has an opening 307, 308 respectively at both end faces 302, 303. The shielding plate for example encloses the plastic housing of an optoelectronic transceiver. The front opening 307 serves for the connection of an optical connector, a conventional plug receptacle for an optical connector, which is not illustrated for purposes of simplicity and clarity, is arranged for this purpose in the interior of the shielding plate 300.

The plug receptacle is in this case preferably surrounded by a non-illustrated inner shielding plate, which in one embodiment is in electrical contact with the inner surface of the main portion 301. On the other hand, the contact springs 304 themselves preferably have no direct contact with the inner shielding plate but might have contact to the inner shield (optional), since a potential difference exists between the inner side and the outer side of the shielding plate 301, attributable to the skin effect and transit time differences.

The contact springs 304 attached to the end face 302 of the main portion 301 are bent back in the direction of the main portion 301. They are curved in a central region and enter at their end into electrical contact with the main portion 301, to be precise in a rear region 309 of the main portion 301. The contact springs in this case preferably rest resiliently on the rear region 309 of the main portion 301.

Figure 3:
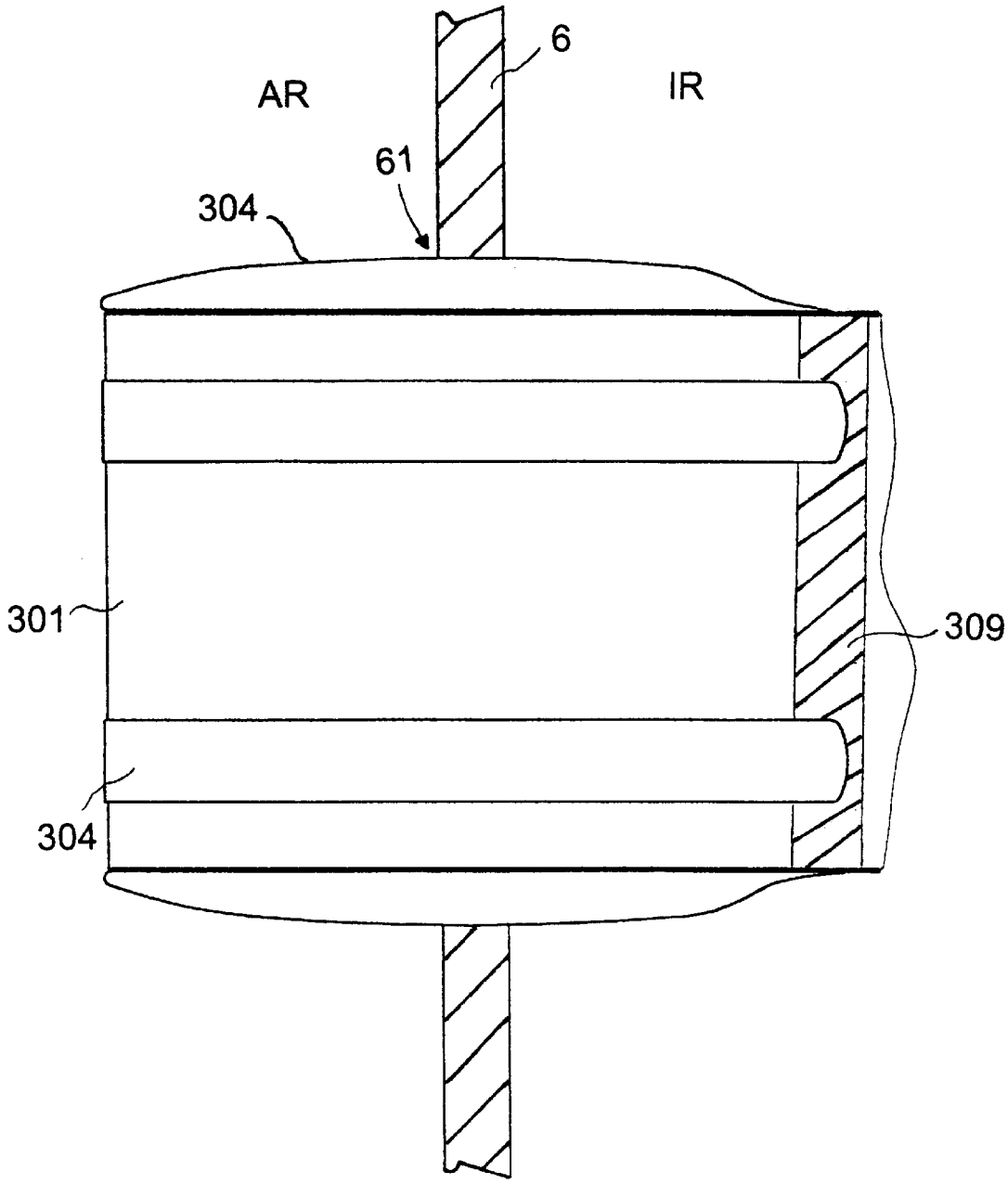
FIG. 3 is a side view of a shielding plate according to the invention which has been inserted into a rear wall.

According to FIG. 3, the contact springs 304 are in contact with a metallic rear wall 6 of a closed metallic structure, which for example forms the rear wall of a housing and connects the shielding plate to a reference potential. Formed in the rear wall is an opening 61, through which the shielding plate can be inserted, the contact springs 304 entering into electrical contact with the plate wall 6.

The continuous structure of the shielding plate has the effect of preventing the occurrence of bottlenecks as they are known, which exist in the case of a shielding plate with clearances. A "bottleneck" is a thin cross-piece which has a current-limiting effect and, for high frequencies, represents an inductance, so that increased radiation disadvantageously takes place.

It is further pointed out that, according to FIG. 3, the rear region 309, wherein the ends of the contact springs 304 contact the main portion, lies in the inside space IR of the metallic structure 6. On the other hand, the end face of the main portion 301 to which the contact springs are attached lies in the outside space AR of the metallic structure 6.

This configuration has the effect of preventing interference potentials from being conducted initially via the shielding plate to the outer side, i.e. to the region of the shielding plate which lies in the outside space AR of the metallic structure. Rather, interfering currents are conducted back in the contact springs 304 to the rear contact 309 with the main portion 301 to the inner-lying part of the main portion 301 and consequently into the inside space IR of the metallic structure and are hindered from being radiated. Radiation consequently takes place essentially only in the inside space IR of the metallic structure, where, in the sense of emissions, it has no interfering effect, and does not enter the outside space AR, so that reduced radiation into the outside space is achieved.

In FIG. 3 it can also be seen that a first part of the main portion 301 is arranged in the inside space IR, that is within the metallic structure, while a second part of the main portion 301 has been inserted through the opening 61 of the metallic rear wall 6 and protrudes into the outside space AR.

Figure 4A:
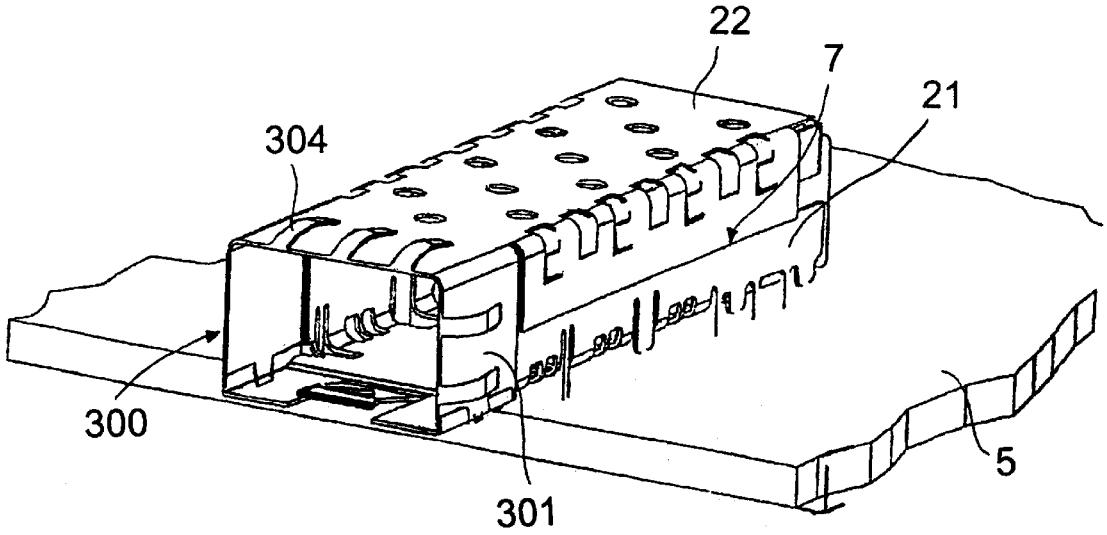
FIG. 4*a* is a perspective view of a two-part housing with a shielding plate according to the invention.

FIG. 4*a* shows an exemplary embodiment of the invention wherein the shielding plate 300 is part of a two-part housing which can be placed onto a printed-circuit board 5 and is intended for receiving the electrical component. The housing comprises an upper part 22 and a lower part 21. Between the upper part 22 and the lower part 21 there necessarily runs a slit 7. In order to prevent interfering radiation from being radiated more intensely into the outside space via the slit 7, on the one hand the side walls of the upper part are drawn down to the printed-circuit board 5 in the region of the shielding plate 300.

On the other hand, the side walls of the upper part 22 have in this region a lug 81 which can be inserted into a corresponding slit 82 of the lower part 21 and can be bent around for the fastening of the upper part and lower part.

Figure 4B:
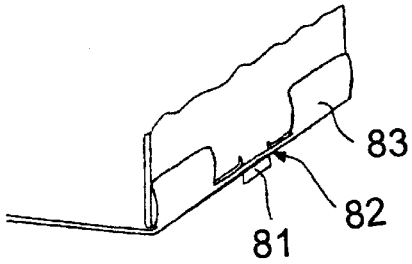
FIG. 4*b* is a partial view of the housing of FIG. 4*a;*

This is represented in some more detail in FIG. 4*b*. In addition, resiliently formed projections 83 are formed on the lower part 21 and bear against the upper part 22 or the main portion 301 of the shielding plate. As a result, an additional shielding effect is achieved and the radiation of electromagnetic waves into the outside space is further reduced. Improved mechanical stability for frequent plugging is achieved as well.

The invention is not restricted in its implementation to the exemplary embodiment described above. All that is essential for the invention is that, in the case of a shielding element, the contact springs are formed by projections arranged at the extreme ends of the main portion and bent back toward the main portion and that the ends of the bent-back projections electrically bond with the main portion in a rear region which, in the electrical bonding of the metallic structure by the contact springs, lies within the metallic structure.

I claim:

1. A shielding plate for pluggable electrical components, comprising:

an at least partially casing-shaped main portion having a substantially continuous first area, a substantially continuous second area forming a continuous structure without any cutouts formed therein, and a forward end adjacent said substantially continuous second area, said main portion forming a substantially continuous part; and contact springs formed on said forward end of said main portion for electrically bonding the shielding plate with a metallic structure having a cutout formed therein for receiving the main portion to be inserted therethrough, whereby said first area is disposed inside the metallic structure and said second area is insertible through the cutout;

said contact springs being projections integrally formed in one piece with said main portion at said forward end and bent back toward said first area of said main portion such that ends of said projections electrically contact said main portion at said first area which, when said contact springs are in electrical contact with the metallic structure, is disposed inside the metallic structure.

2. The shielding plate according to claim 1, wherein said main portion is a cut-open main portion and said projections are a comb-like, partial elongation of said cut-open main portion.

3. The shielding plate according to claim 1, wherein said projections are substantially rectangular projections.

4. The shielding plate according to claim 1, wherein said first area has a rear region and said contact springs rest resiliently on said rear region.

5. The shielding plate according to claim 1, wherein said casing-shaped main portion forms a part of a two-part housing configured to be placed onto a printed-circuit board and intended for receiving an electrical component, said housing comprising an upper part and a lower part.

6. The shielding plate according to claim 5, wherein said upper part is formed with side faces having a lower end and a lug formed on said lower end to be inserted into a slit formed in said lower part, wherein the lug can be bent over for fastening said upper part and said lower part to one another.

7. The shielding plate according to claim 5, wherein said lower part is formed with resiliently formed projections bearing against said upper part.

8. The shielding plate according to claim 1, which comprises an inner shielding plate, forming an integral part of a transceiver, within said casing-shaped main portion and in electrical contact with an inner surface of said main portion.

9. The shielding plate according to claim 1 configured to receive therein an optoelectronic transceiver.

* * * * *